United States Patent [19]

Shaw

[11] Patent Number: 4,497,185

[45] Date of Patent: Feb. 5, 1985

[54] OIL ATOMIZING COMPRESSOR WORKING FLUID COOLING SYSTEM FOR GAS/VAPOR/HELICAL SCREW ROTARY COMPRESSORS

[75] Inventor: David N. Shaw, Unionville, Conn.

[73] Assignee: Dunham-Bush, Inc., West Hartford, Conn.

[21] Appl. No.: 536,046

[22] Filed: Sep. 26, 1983

[51] Int. Cl.[3] ..... F25B 43/02

[52] U.S. Cl. ..... 62/468; 62/470; 62/473; 418/99

[58] Field of Search ..... 62/84, 468, 470, 473; 418/99

[56] References Cited

U.S. PATENT DOCUMENTS

| | | | |
|---|---|---|---|
| 3,581,519 | 6/1971 | Garrett, Jr. et al. | 62/468 |
| 3,811,291 | 5/1974 | Schibbye | 62/473 |
| 3,848,422 | 11/1974 | Schibbye | 62/468 |
| 3,945,216 | 3/1976 | Schibbye | 62/470 |
| 4,375,156 | 3/1983 | Shaw | 62/468 |

*Primary Examiner*—Ronald C. Capossela
*Attorney, Agent, or Firm*—Sughrue, Mion, Zinn, Macpeak and Seas

[57] ABSTRACT

Where a helical screw compressor gas or vapor working fluid is not too soluble in the compressor lubricant for compression process cooling, such lubricant after separation from the working fluid and cooled to as a low a temperature as possible and operating at as high a pressure as possible, is fed to an atomizing nozzle and injected into the inlet end of the compressor. This produces a cloud type blanket of cool atomized droplets uniformly dispersed within the suction vapor or gas allowing the highest possible rate of heat transfer to occur during the compression process and achieving the highest possible isothermal efficiency in a gas compression system or operation near vapor saturation values in a refrigeration vapor compression system while avoiding large hydraulic losses in the compressor. Working fluids such as helium, air, and ammonia may provide extremely high superheated gas or vapor at the compressor inlet.

6 Claims, 2 Drawing Figures

10
2.
48
44
22
12
36
46
68a
70
42
M
24
68a
70
87
50
70'
38
40
88
2.
26
28
78
76
20
84
14
86
82
0
80
54
56
68
HOT OIL
52
34
60
62
64
66
58
EVAPORATOR, 18
32
30
CONDENSER, 16
EXPANSION VALVE 48
36
37
12
38
39
42
70
40
42
70
70
70

OIL ATOMIZING COMPRESSOR WORKING FLUID COOLING SYSTEM FOR GAS/VAPOR/HELICAL SCREW ROTARY COMPRESSORS

FIELD OF THE INVENTION

This invention relates to helical screw compressor refrigeration and gas compression systems which may utilize an extremely high superheated vapor at the compressor inlet, and more particularly to systems for maximizing the isothermal efficiency of the gas compression process or compression of vapor to near saturation values by utilizing low temperature, high pressure lubricating oils to achieve that end.

BACKGROUND OF THE INVENTION

A lubricating fluid such as a hydrocarbon oil is incorporated within and circulated through a refrigeration or gas compression circuit utilizing a helical screw rotary compressor to compress the working fluid. The lubricating oil performs multiple functions, one of which is to lubricate the moving parts of the compressor and to achieve sealing of the compression chamber defined by the moving parts, i.e. the intermeshed helical screw rotors within the casing bores during their rotation. Another is to cool the working fluid. The performance of the lubricant requires that the compression process and the lubricant itself be cooled. Conventionally, the oil miscible with the refrigerant working fluid or mixed with gas is discharged with the working fluid at a high pressure from the compressor, is separated from the working fluid in an oil separator and returned to the compressor. Typically, the oil is cooled within an oil cooler and is pressurized by an oil pump prior to injection into the compressor via injection ports opening to the compression process itself.

Compression systems utilizing helical screw rotary compressors employ conventional refrigerants such as R12, R22, R114, R500, and R502. However, with such refrigerants as R12 and R22, the lubricant tends to dissolve a very large quantity of refrigerant. Such refrigerants may start the compression process at a very low superheat level along with the high refrigerant entrained in a cooled oil. In some systems, air, helium, ammonia ($NH_3$) may comprise the working fluid of the compression process, and attempts have been made to improve the isothermal efficiency of the compression process for these types of working fluids.

It is an object of the present invention to provide a compression system utilizing a helical screw rotary compressor where the working fluid may comprise highly superheated vapor at the inlet to the compression process.

It is a further object of the present invention to provide a compression system including a helical screw rotary compressor where the working fluid gas or vapor being compressed is not highly soluble in the compressor lubricant or compressor process cooling liquid utilized within the system and wherein the efficiency of compression is materially improved.

SUMMARY OF THE INVENTION

The invention is generally directed to a gas or vapor compression system which includes a helical screw compressor for compressing a gas or vapor working fluid. The compressor comprises a compressor casing including parallel side-to-side intersecting bores, end plates at the ends of the bores closing off the ends of the casing, intermeshed helical screw rotors mounted for rotation within their bores for rotation about the screw rotor axes and defining a compression chamber therebetween, means defining a low pressure suction port and high pressure discharge port within the compressor opening to the intermeshed helical screw rotors and to the compression chamber and means for feeding a low pressure working fluid suction gas or vapor to the suction port for compression within the compression chamber. The improvement comprises atomizing nozzles carried by the compressor opening to the low pressure working fluid suction gas or vapor prior to compression and means for supplying a cooling liquid at a pressure higher than the compressor suction pressure for atomization within the nozzles to produce a cloud type blanket of cool atomized droplets uniformaly dispersed within the suction vapor or gas allowing the highest possible rate of heat transfer to occur during the compression process, the achievement of the highest possible isothermal efficiency in a gas compression system or operation at near vapor saturation values for the working fluid in a vapor compression system while avoiding large hydraulic losses in the compressor. The nozzles may be mounted within the compressor end plate proximate to the suction port and facing the inlet end of the intermeshed helical screw rotors. The nozzles may be circumferentially equally spaced about the axis of the respective rotors. Alternatively, the nozzles may be carried within the casing and opening to the bores bearing respective helical screw rotors, proximate to the suction port of the compressor.

DESCRIPTION OF THE PREFERRED EMBODIMENT

Figure 1:
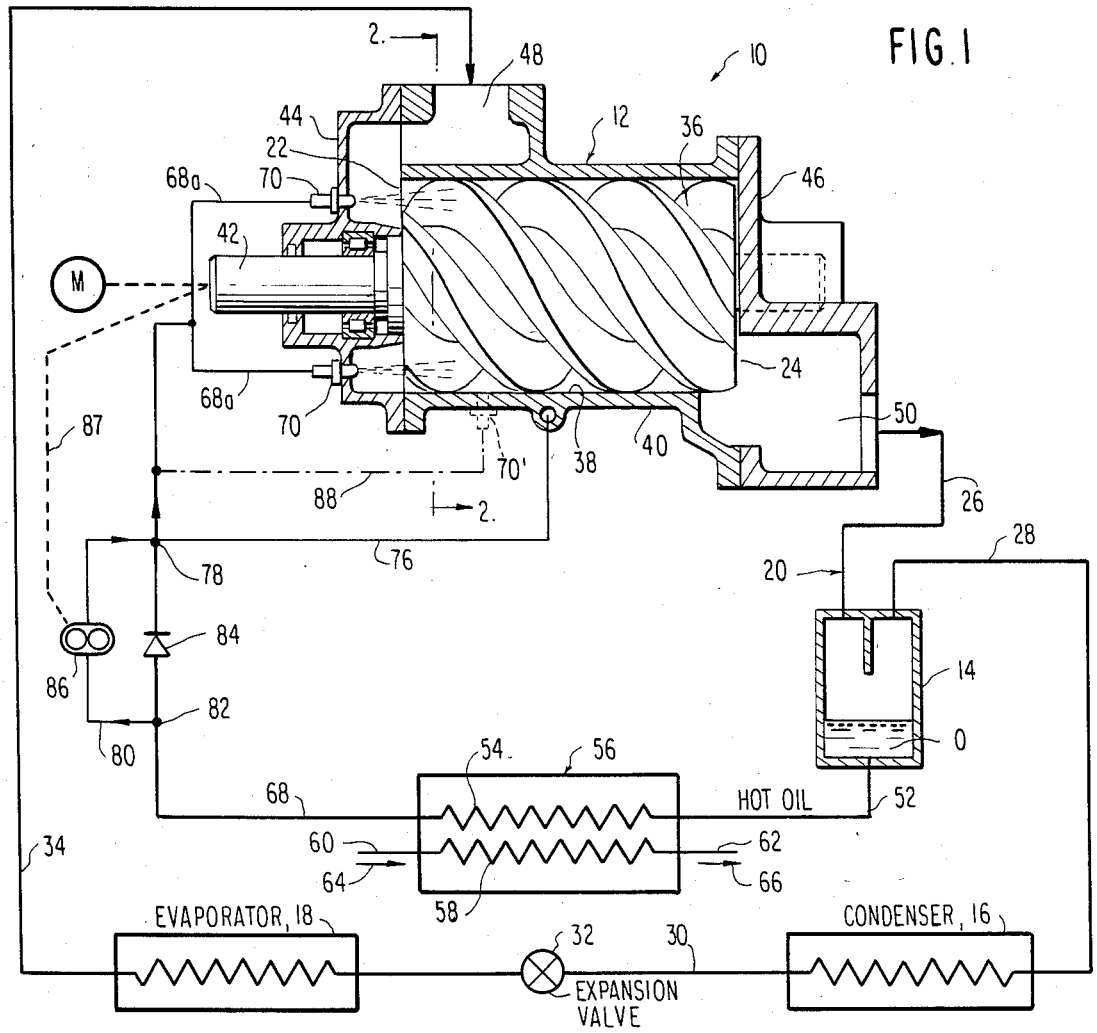
FIG. 1 is a schematic diagram of a closed loop refrigeration system having the highest possible isothermal efficiency in accordance with forming a preferred embodiment of the present invention.

Referring to FIG. 1, there is shown a refrigeration system indicated generally at 10 which includes as principal elements thereof a helical screw rotary compressor indicated generally at 12 and illustrated in longitudinal cross-section, an oil separator and sump 14, a condenser 16, and an evaporator 18, in series and in that order, connected in the closed loop by conduit means indicated generally at 20. In that respect, the compressor 12 conventionally comprises housing or casing 40, closed off at its ends by end walls 44, 46, bearing an inlet or suction port 22, and an outlet or discharge port 24, respectively. The compressor discharge port 24 is connected via conduit 26 to the oil sump 14. Conduit 28 leads from the oil sump to the condenser 16. A further conduit 30 leads from the condenser to the evaporator 18. Conduit 30 includes an expansion valve 32 functioning to expand the high pressure condensed refrigerant within the coil constituting the evaporator 18 for the system.

As may be appreciated, a further conduit 34 returns the relatively low pressure, refrigerant vapor back to the suction side of the compressor 12, entering the compression process by suction port 22. As may be appreciated, the present invention has application to compression systems and processes utilizing helical screw rotary compressors, such as air compressor systems which are not refrigeration systems but where, in the nature of the process, there may be an extremely highly superheated working fluid vapor at the compressor inlet. The illustrated system in FIG. 1 is illustrative of a typical closed loop compression process to which the invention has application.

Compressor 12 includes a pair of intermeshed helical screw rotors as at 36, 37, which are rotatably mounted within parallel side intersecting bores 38, 39, of compressor casing 40. The rotors 36, 37, are mounted by shafts as at 42 for rotation about their axes. The bores are closed off at their ends by the end plates 44 and 46, through which project shafts 42. Further, portions of the compressor casing 40 and end plates as at 44, 46 define passages such as suction passage 48 leading to the compressor suction port 22 and discharge passage 50 to which conduit 26 is connected for supplying the compressed working fluid and entrained lubricant to oil separator 14. The screw rotor ends are shown as being spaced from the end plates. With the refrigerant working fluid comprising ammonia ($NH_3$), for instance, to improve the isothermal efficiency of the compression process, the present invention, in one form, utilizes the lubricating oil (cooled to as low a temperature as possible and operating at as high a pressure as possible), as the means for achieving that end. In that respect, a hot oil line 52 is connected to the bottom of the oil separator and sump 14 so as to receive separated oil O within the oil sump and pass it through a first heat exchange coil 54 within an oil cooler indicated generally at 56. The oil cooler 56 carries a second coil 58 through which a cooling media is circulated via an inlet line 60 leading to the coil and outlet line 62 leading therefrom. The cooling medium is shown schematically by arrows 64 entering the coil 58 and leaving coil 58 as at arrow 66 and may comprise water.

A further oil line 68 connects to the discharge end of coil 54 within the oil cooler 56, and this highly cooled oil is then fed to a series of atomizing nozzles 70 mounted to the inlet end plate 44 of the helical screw rotary compressor 12, via line 68. Line 68 is shown as being branched at **68*a* to supply oil to multiple nozzles 70. A multiplicity of nozzles 70 are utilized on both the female inlet end and male inlet end of the intermeshed helical screw rotors 36, 37, FIG. 2. Viewing the inlet end of compressor 12, the nozzles 70 are located at a uniform distance from the center of each particular rotor 36, 37. For example, three atomizing nozzles 70 may be provided for each rotor 36, 37, with approximately equal circumferentially spacing, and with all nozzles 70 at approximately the same distance from the rotor centers as defined by the axes of shafts 42 mounting the screw rotors. The nozzles 70 atomize the oil and spray it into the working fluid at suction pressure within the space between the rotor ends and inlet end plate 44**.

It is the primary object of the present invention to flood the inlet of the compressor with a cloud type or blanket of cool atomized oil droplets uniformly dispersed within the suction vapor or gas entering compressor suction port 22 through suction passage 48. This allows the highest possible rate of heat transfer to occur during the compression process, itself thus achieving the highest possible isothermal efficiency while avoiding large hydraulic losses in the machine.

As may be appreciated, while such a process would most likely be detrimental when compressing a refrigerant vapor starting at a very low superheat level along with high refrigerant entrainment in the cooled oil O, the nature of the process when dealing with an extremely highly superated vapor such as ammonia or helium at the inlet to the compressor 12 results in significant efficiency boost on the machine. For example, where helium comprises the working fluid for the compression process at the pressures and temperatures normally employed, there is very little helium absorption into typical hydrocarbon lubricating oils. Thus, losses normally associated with instantaneous foaming of the oil depressurized at the compressor inlet will not occur.

In addition to line **68*a*, there is a further oil supply line 76 which joins line 68 at point 78, and leads to the screw compressor housing or casing 40 and via various lines or passages within the casing 40 (not shown) to points requiring lubrication within the compressor. Additionally, a bypass line 80 leads from point 82 downstream of point 78 within line 68, and around a check valve 84 where it again joins line 68 at point 78 from which line 76 branches. Within line 80, there is provided an oil pump indicated schematically at 86 which allows the compressor to drive the oil pump via mechanical connection 87 from compressor shaft 42 which is connected to motor M and driven thereby. Other motive power may drive the pump to pressurize the oil within line 68 to a pressure above compressor discharge pressure prior to return to the system. The pump 86 may be optional since the injection of oil through the nozzles 70 occurs at the suction side of the machine with the oil at near compressor discharge pressure nozzles, and which sees the low suction pressure in contrast to the relatively high discharge pressure within the outlet or discharge port passage 50 leading to conduit 26**.

Figure 2:
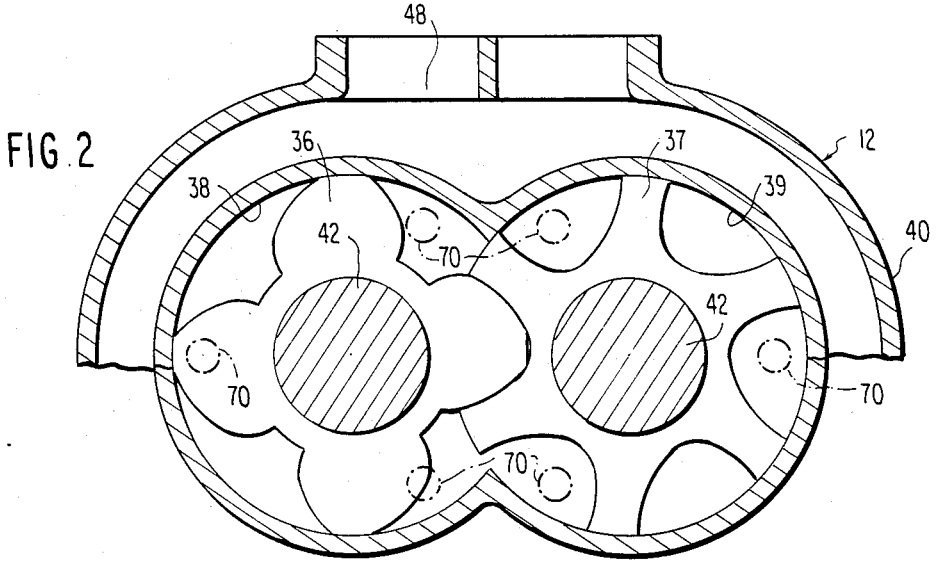
FIG. 2 is a transverse sectional view of the suction end of the helical screw compressor forming a component of the system of FIG. 1 about lines 2—2.

In addition, although the system envisions the nozzles injecting directly upstream of the rotor intake on the suction side of the machine as shown by nozzles 70, FIGS. 1 and 2, atomized injection may take place by means of a plurality of nozzles as at 70' mounted within casing 40 and opening to the bores 38, 39, bearing the helical screw rotors 36, 37. Nozzles 70' then are fed via a line 88 which connects to oil supply line 68 downstream from oil pump 86. The nozzles 70' are located at positions such that the oil injected in atomized form from the nozzles occurs just after the working fluid suction charge is locked in the rotors 36, 37, at a closed thread. This technique may be highly advantageous when using a compressible working fluid that readily dissolves into the lubrication fluid.

The potential power savings through the utilization of the present invention is very high when using compressible working fluids such as air, helium, etc., where the exponent of compression is high. Air with an exponent of 1.4 exhibits a savings of 15 percent in power consumption when compressed from zero psig to 100 psig. Such air compression occurs in hundreds of thousands of installations throughout the United States. Additionally, if lubricants can be found which will not dissolve excessive quantities of refrigerant such as R12, R22, R500, R502, R114 etc., the present invention is highly useful in all compression systems employing such refrigerants.

The illustrated embodiment which is, of course, nonlimiting, utilizes ammonia ($NH_3$) as the refrigerant working fluid. A typical nonmiscible lubricating oil such as that sold by Texaco Corporation under the trademark or trade name CAPELLA-B may constitute the oil O within the system. It is important to maintain oil flow to the nozzles 70 in sufficient quantity so that the compression process takes place under near isothermal conditions for gas compression systems and under near saturation values for the refrigerant working fluid in a refrigerant vapor compression system. It should be kept in mind that if the system operates so far from saturated conditions, one may operate with a cooling (lubricating) liquid which could be miscible in the compressor working fluid. However, when the cooling fluid is one which is not miscible in the working fluid, the compression system may operate with the working fluid vapor close to saturation.

While the invention has been particularly shown and described with reference to a preferred embodiment thereof, it will be understood by those skilled in the art that various changes in form and details may be made therein without departing from the spirit and scope of the invention.

What is claimed is:

1. In a gas or vapor compression system including:

a helical screw compressor for compressing a gas or vapor working fluid, said compressor comprising:

a compressor casing including parallel, side-to-side intersecting bores, end plates at the ends of said bores closing off the ends of said casing, intermeshed helical screw rotors mounted for rotation within said bores for rotation about their axes and defining with said casing a compression chamber therebetween, means defining a low pressure suction port and a high pressure discharge port within said compressor opening to said intermeshed helical screw rotors at opposite ends thereof, means for feeding a low pressure working fluid suction gas or vapor to said suction port for compression within said compression chamber, the improvement comprising:

atomizing nozzles carried by said compressor opening to said low pressure working fluid suction gas or vapor prior to compression, and means for supplying a cooling liquid at a pressure higher than compression suction pressure for atomizing within said nozzles at a flow rate sufficient to produce a cloud type blanket of cool atomized liquid droplets uniformly dispersed within the suction gas or vapor for allowing the highest possible rate of heat transfer to occur between the cooling liquid and the working fluid during the compression process to effect the highest possible isothermal efficiency of the compressor when in a gas compression system or for compression process operation at near vapor saturation value in a vapor compression system while avoiding large hydraulic losses in the compressor.

2. The gas or vapor compression system as claimed in claim 1, wherein said nozzles are mounted in the end plates adjacent said suction port and face the inlet ends of the intermeshed helical screw rotors.

3. The gas or vapor compression system as claimed in claim 1, wherein said nozzles are mounted within said casing and open to the bores within which are mounted said intermeshed helical screw rotors at positions proximate to said suction port.

4. The gas or vapor compression system as claimed in claim 1, wherein said system further comprises an oil sump and an oil cooler, first conduit means forming a closed loop and connected from said compressor discharge port in that order to said nozzles, and connecting, in order, said an oil separator and sump and said oil cooler, and wherein said cooling liquid comprises a lubricating oil.

5. The gas or vapor compression system as claimed in claim 4, comprising a check valve within said first conduit means leading from said oil cooler to said spray nozzles, a branch line bypassing said check valve and including an oil pump therein, means for driving said oil pump and auxiliary conduit means opening to the first conduit means leading from the check valve to the nozzles for supplying oil under pressure to points within said compressor casing requiring oil lubrication.

6. The gas or vapor compression system as claimed in claim 1, wherein said working fluid comprises a vaporizable refrigerant, and said system further comprises second conduit means connected to the oil separator and sump at one end and operatively connected to the compressor suction port at the other end, and wherein said second conduit means connect said refrigerant condenser and evaporator in that order downstream of said oil sump within a closed loop, and expansion valve means between the condenser and the evaporator and upstream of the evaporator for effecting vaporization of the refrigerant within the evaporator to effect a cooling action for a fluid passing through the evaporator, and wherein said cooling liquid comprises a lubricating oil which is non-miscible relative to said refrigerant vapor working fluid.

* * * * *